United States Patent [19]

Kawakami et al.

[11] 4,176,518

[45] Dec. 4, 1979

Best Available Copy

[54] ELECTRONIC CLOCK HAVING AUDIBLE TIME INDICATION

[75] Inventors: Hakuhei Kawakami; Takeshi Ishihara, both of Neyagawa; Kenzo Hatada, Katano, all of Japan

[73] Assignee: Matsushita Electric Industrial Co., Ltd., Osaka, Japan

[21] Appl. No.: 814,085

[22] Filed: Jul. 8, 1977

[51] Int. Cl.[2] ..... G04C 21/12; G08B 8/00

[52] U.S. Cl. ..... 58/38 R; 58/13; 58/19 R; 340/384 E; 340/407

[58] Field of Search ..... 58/7–15, 58/19, 21.12, 23 R, 38, 575, 19 R, 19 A, 19 B, 19 C, 59, 60–62, 85.5, 126 C, 152 B, 38 R, 38 A; 340/384 R, 384 E, 392, 407

[56] References Cited

U.S. PATENT DOCUMENTS

| | | | |
|---|---|---|---|
| 3,728,855 | 4/1973 | Preiser | 58/38 R |
| 3,759,029 | 9/1973 | Komaki | 58/38 R |
| 3,938,317 | 2/1976 | Spano | 58/23 |
| 4,073,133 | 2/1978 | Earls et al. | 58/13 |
| 4,090,349 | 5/1978 | Takase | 58/57.5 |

*Primary Examiner*—Edith S. Jackmon

*Attorney, Agent, or Firm*—Wenderoth, Lind & Ponack

[57] ABSTRACT

The present invention is an electronic time indicating signal clock of a hand indication type. It has a time indicating signal generating function marking time by one or more electronic tones and a correction function in which the number of tones made for a set time may be easily corrected.

7 Claims, 15 Drawing Figures

VDD
OUTPUT

C4
R4
TG1
Tn1
TP1
Tn2
TG2
TP2
I9
I10
I11
I12
C5
R5
D
d
f
NO4
NO5
OR1
OR2
AN1
AN2
F/F5
F/F6
F/F7
F/F8
F/F9
F/F10
F/F11
F/F12
EX1
EX2
EX3
EX4
AN3
OR4
i
h
SR14
SR13
SR15
I13
a
b
c
NO2
NO3
I7
I6
SR4
SR3
I8
NA1
NA2
NA3
OR3
I4
SR2
SR1
I3
R3
I2
C3
R1
I1
C1
S1
R2
I5
C2
S2

VDD
OUTPUT

NO1
NO2
NO3
NO4
NO5
OR1
OR2
OR4
AN1
AN2
AN3
EX1
EX2
EX3
NA1
NA2
NA3
SR1
SR2
SR3
SR4
SR13
SR14
SR15
F/F5
F/F6
F/F7
F/F8
F/F9
F/F10
F/F11
F/F12
TG1
TG2
Tn1
Tn2
TP1
TP2
R1
R3
R4
R5
C1
C2
C3
C4
C5
K1
K2
S1
S2
a
b
c
d
e
f
g
h
i

ELECTRONIC CLOCK HAVING AUDIBLE TIME INDICATION

BACKGROUND OF THE INVENTION

The present invention relates to a time signal clock which indicates the time by moving a pointer with a motor drive, using a quartz oscillator or the commercial power frequency as the standard frequency, while giving time signals by sound.

Heretofore, in analog type electronic clocks or watches in which a quartz oscillator or the commercial power frequency is used as the standard oscillation source, the standard frequency is divided into a pulse signal of 1 Hz by a dividing circuit, this signal drives a step motor, and by interlocking the motor shaft with the hands, the time is indicated on the graduated face of the clock or watch.

With conventional clocks of this type, it is possible to provide visual perception of time by analog indication of time by the angle of the pointer, but they can not be equipped with a time signal generating means such as will produce a striking sound like such means provided in mechanical clocks.

However, not only the visual but also the auditory sense is a very important means of perceiving time. For example, it is possible to readily perceive the time by a time indicating sound signal while engaged in work without glancing at the clock repeatedly. Further, the time as signaled by sound may be perceived by a person outside the angle from which the face of the clock is visible. The conventional electronic clocks with indicating hands are deficient in that they have no time signal indicating means as described above.

BRIEF SUMMARY OF THE INVENTION

The present invention is intended to solve the above-described inconvenience and an object of the present invention is to provide a time signal clock equipped with a time signal generating means, such as a sound, source, and which also indicates the time by moving a pointer means, such as hands, with a motor drive under the control of a quartz oscillator or the commercial power frequency providing a standard frequency.

A further object of the present invention is to provide a time signal clock having a time indicating function created by electronic sounds.

A still further object of the present invention is to provide a time signal clock having a correction function, by which easy corrections of the number of times the time indicating function sounds for a set time may be made.

Other and further objects, features and advantages of the invention will appear more fully from the following description.

DETAILED DESCRIPTION OF THE PRESENT INVENTION

Figure 1:
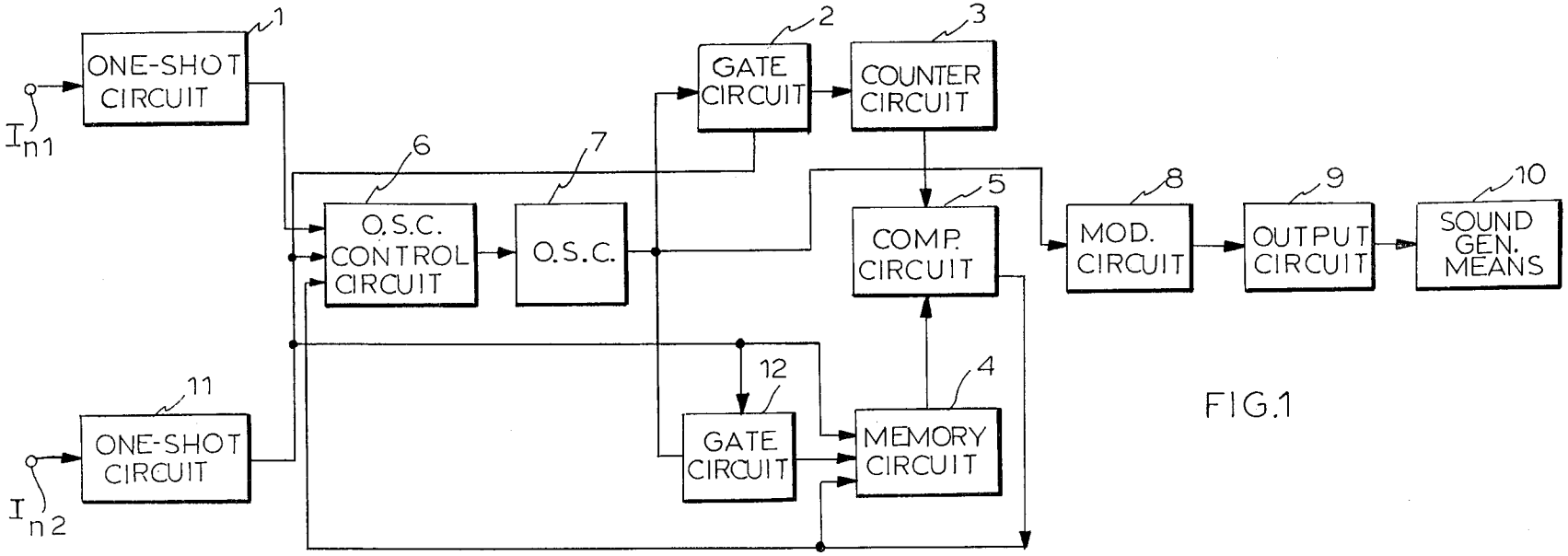
FIG. 1 is a schematic block diagram of a time signal indication section of a time clock, according to the present invention.

First, the time signal indicating section of a time signal clock of this invention is shown schematically in FIG. 1. In FIG. 1, the signal level of an input terminal $I_{n1}$ changes when a detection signal produced when a time detection means detects the set time (for example, 0 minute and 0 second) is added thereto. The wave form of the input signal added thereto is shaped by a one-shot circuit 1 and transmitted to a pulse oscillation circuit 7 through a pulse oscillation control circuit 6. The pulses produced from the pulse oscillation circuit are counted by a counter circuit 3. Thereafter, the number of pulses counted by the counter circuit 3 is compared with the number of pulses previously memorized in a memory circuit 4 by a comparison circuit 5. Upon finding the numbers of pulses in agreement, an indication signal from the comparison circuit 5 is transmitted to the pulse oscillation control circuit 6, while a one is added to the number memorized in the memory circuit 4, and the pulse production from the pulse oscillation circuit 7 is stopped. The pulses produced by the pulse oscillation circuit 7 are converted into audible frequencies by a modulation circuit 8, and after being current-amplified by an output circuit 9, are transmitted to a time announcing device 10 such as an audio speaker or the like.

Furthermore, when it is necessary to correct the number of time indicating audio signals generated from the time announcing device, a time correction switch (not shown in this Figure) is operated and the switch operation-related signal is added to an input terminal $I_{n2}$. The input signal added thereto is transmitted to a one-shot circuit 11 for producing a pulse at the time of the start of the correction-switch operation and at the time of the end of the correction-switch operation. Both pulses are applied to gate circuits 2 and 12, to the pulse oscillation control circuit, and to the memory circuit 4 as a reset signal thereof. The pulse produced from the one-shot circuit 11 at the time of the start of the correction-switch operation serves to generate pulses from the pulse oscillation circuit 7, and with the gate circuit 2 closed and the gate circuit 12 opened, the number of the pulses from the pulse oscillation circuit 7 is counted by the memory circuit 4. The pulses from the pulse oscillation circuit 7 are further applied to the time announcing device 10 through the modulation circuit 8 and the output circuit 9, whereby the specified number of the time indicating audio signals are produced. When the desired number of the time indicating signals have been produced, the correction switch operation is ended, and thereby a pulse is again produced by the one-shot circuit 11 and applied to the pulse oscillation control circuit 6, to stop the pulse production. Then, after completing the correction, the one-shot circuit 11 causes the gate circuit 2 to be opened, and the gate circuit 12 to be closed, and thereupon a one is added to the number memorized in the memory circuit 4.

Figure 2:
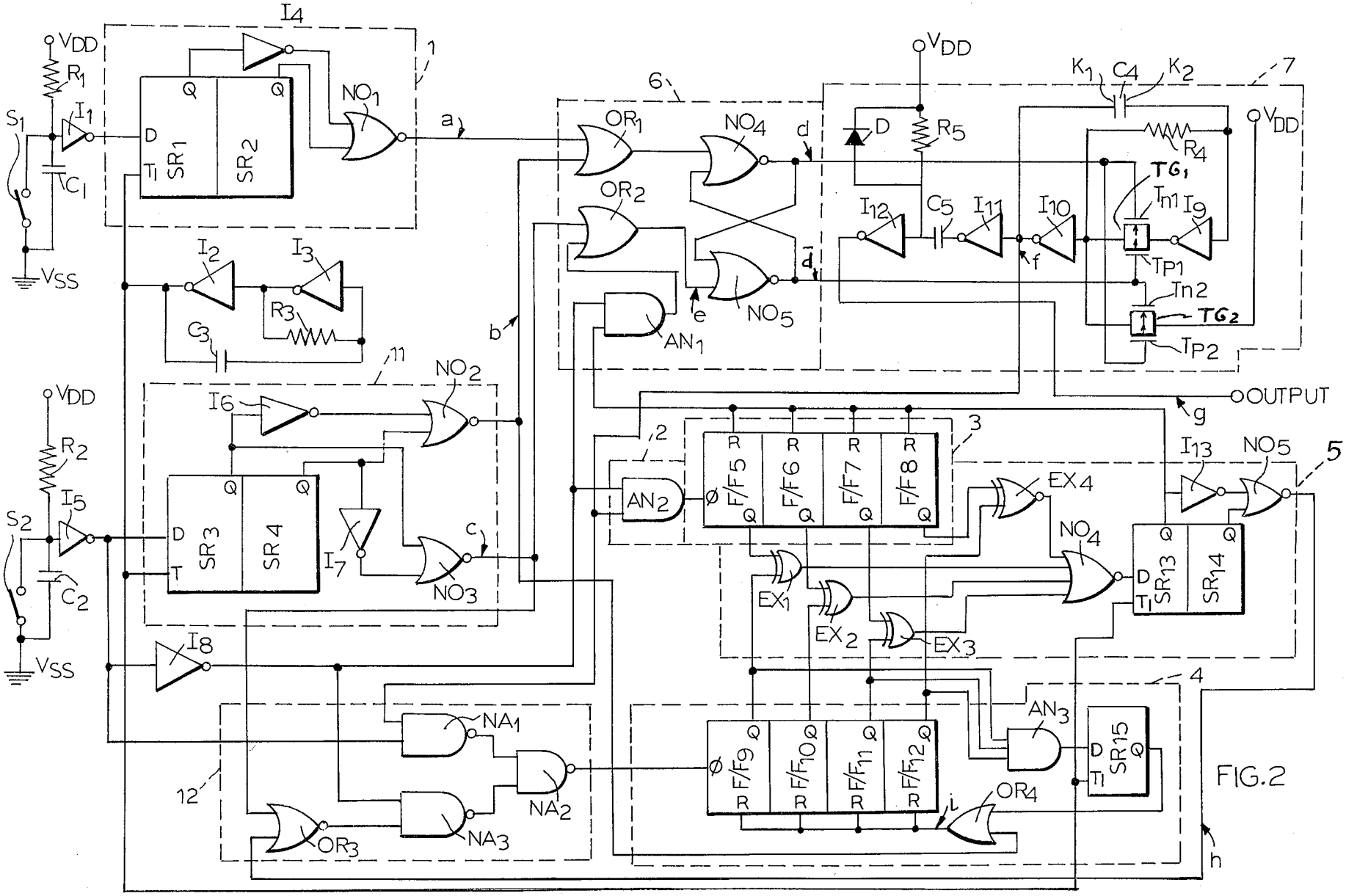

In the following, a further detailed explanation of the block diagram of FIG. 1 will be made with reference to a circuit diagram of FIG. 2. In FIG. 2, the switch $S_1$ is a detection switch for detecting the set time and producing the signal to be added to the terminal $I_{n1}$. The detection switch $S_1$ is composed of, for example, a reed switch and a permanent magnet installed on gears interlocked with the minute hand and the second hand, which magnet is so arranged as to approach the reed switch only when both the minute and second hands come to the position of 12 o'clock on the face of the clock. When the magnet approaches the reed switch, the switch is closed input $I_{n1}$ is brought to the $V_{SS}$ level (based on positive logic, the level on the low potential side of the power source is set to the "0" level, while that on the high potential side $V_{DD}$ is set to the "1" level). Detailed description of the set time detection device is put off for now; the time announcing circuit is described first of all. The switch $S_1$ and a capacitor $C_1$ are each connected to the $V_{SS}$ side of the power supply at one end, and at the other end, to one end of a resistance $R_1$, the other end of which is connected to the $V_{DD}$ side of the power supply, and also to the input terminal of an inverter circuit (hereinafter abbreviated as I), $I_1$. The output of $I_1$ enters a shift register (hereinafter abbreviated as SR) $SR_1$ as the input thereto. The output of $SR_1$ enters $SR_2$ as the input thereto. The clock signal $T_1$ to $SR_1$ and $SR_2$ is the output signal from a CR oscillation circuit composed of inverters $I_2$, $I_3$ and resistance $R_3$ and capacitor $C_3$, which is the output from the inverter $I_2$, the period of which is $$T_1 = \frac{1}{C_3 \cdot R_3}.$$

The output terminal Q of $SR_1$ is connected to an input terminal of $I_4$. The one-shot circuit 1 is composed of $SR_1$, $SR_2$ and $I_4$, with a NOR circuit (hereinafter abbreviated as NO) $NO_1$ receiving as the input thereto the output of $I_4$ and the output of $SR_2$.

A switch $S_2$ is a push button switch which is closed at the time of correction operation, and is brought to the $V_{SS}$ level. The switch $S_2$ and a capacitor $C_2$ are each connected to the $V_{SS}$ side at one end, and at the other end, to one end of a resistance $R_2$, the other end of which is connected to the $V_{DD}$ supply, and to the input terminal of $I_5$. The output terminal of $I_5$ is connected to the input terminal of $SR_3$, and the output terminal of $SR_3$ to an input terminal of $SR_4$. The aforementioned clock signal $T_1$ is supplied to the clock signal terminals of $SR_3$ and $SR_4$. The output terminal of $SR_3$ is connected to the input terminal of $I_6$. One-shot circuit 11 is composed of $SR_3$, $SR_4$, $I_6$ and NOR circuit $NO_2$ receiving, as the inputs thereto, the output of $I_6$ and the output of $SR_4$.

The output terminal of $SR_4$ is also connected to the input terminal of $I_7$, and another one-shot circuit is formed with a NOR circuit $NO_3$ receiving, as inputs, the output of $I_7$ and the output of $SR_3$. An OR circuit (hereinafter abbreviated as OR) $OR_1$ receives, as inputs, the outputs a, b from $NO_1$ and $NO_2$. The output of $OR_1$ enters, as a set input, a RS flip-flop (hereinafter flip-flop being abbreviated as F/F) composed of two NOR circuits $NO_4$ and $NO_5$. The output terminal of $I_5$ is further connected to the input terminal of $I_8$. The output from an AND circuit (hereinafter abbreviated as AN) $AN_1$ receiving, as inputs, the output of $I_8$ and an output of $SR_{13}$ enters OR circuit $OR_2$, together with the output C from $NO_3$, as an input thereto. The output e of $OR_2$ is added to the RSF/F, as the reset input.

In the pulse oscillation circuit 7, one end of a resistance $R_4$ and a capacitor $C_4$ is connected to the input terminal of inverter $I_9$. The output terminal of $I_9$ is connected to the input terminal of a transfer gate circuit (hereinafter abbreviated as TG) $TG_1$ composed of a pair of field effect transistors (hereinafter abbreviated as FET), one a p-channel FET (hereinafter abbreviated as Tp) $Tp_1$ and the other an n-channel FET (hereinafter abbreviated as Tn) $Tn_1$. The output terminal of $TG_1$ is connected both to the other end of the resistance $R_4$ and to an output terminal of another $TG_2$ composed of $Tp_2$ and $Tn_2$, the input terminal of which is connected to the $V_{DD}$ supply. The outputs of $TG_1$ and $TG_2$ are added to an $I_{10}$ and the output terminal thereof is coupled to the other end of the capacitor $C_4$. On the other hand, the gates of $Tn_1$ and $Tp_2$ are associated with an output terminal of RSF/F, i.e., the output d of $NO_4$. The gates of $Tp_1$ and $Tn_2$ are associated with an output of RSF/F, i.e., the output d of $NO_5$. This output is in the inverse phase to the output d of $NO_4$, whereby the pulse oscillation circuit 7 is operated to produce pulses for the time indicating signals in synchronization with the set input.

The output of $I_{10}$, is converted into a pulse with a low duty cycle through a differential circuit composed of an inverter $I_{11}$, resistance $R_5$, capacitor $C_5$ and diode D and through a wave form shaping inverter $I_{12}$, thus producing pulse g which is supplied to the modulation circuit 8. The output of $I_{10}$, together with the output of $I_8$, enters $AN_2$ as an input, and the output terminal of $AN_2$ is coupled to the input terminal of the counter circuit 3, that is the input terminal of $F/F_5$. The counter circuit is so arranged that an output terminal of $F/F_5$ is connected to an input terminal of $F/F_6$, an output terminal of $F/F_6$ to an input terminal of $F/F_7$ and an output terminal of $F/F_7$ to an input terminal of $F/F_8$. The output terminal of a NAND circuit (hereinafter abbreviated as NA), $NA_1$ receiving, as inputs, an output from the pulse oscillation circuit 7, i.e., the output f of $I_{10}$ and the output of $I_5$, and an output terminal of $NA_3$ receiving, as inputs, both the output of $I_8$ and the output from the OR circuit $OR_3$ receiving, as the inputs, both the output C from $NO_3$ and the output from the comparison circuit 5, i.e., the output h of $NO_5$, are connected to the input terminal of $NA_2$. The memory circuit 4 has an input terminal $\phi$ of $F/F_9$ which is so arranged that an output terminal of $F/F_9$ connected to an input terminal of $F/F_{10}$, an output terminal of $F/F_{10}$ to an input terminal of $F/F_{11}$, and an output terminal of $F/F_{11}$ to an input terminal of $F/F_{12}$. An AND circuit $AN_3$ receiving, as its inputs, the outputs of $F/F_{10}$, $F/F_{11}$ and $F/F_{12}$ has an output terminal attached to an input terminal of $SR_{15}$. An output i from $OR_4$ receiving, as inputs, the output of $SR_{15}$ and the output b of $NO_2$ is transmitted to $F/F_9$ through $F/F_{12}$ as the reset input, whereby the memory circuit 4 is composed as a triodecimal counter. Both the output terminal of $F/F_9$ and the output terminal of $F/F_5$ are coupled to input terminals of an Exclusive OR (hereinafter abbreviated as EX) $EX_1$, then, the output terminals of $F/F_{10}$ and $F/F_6$ to input terminals of $EX_2$, the output terminals of $F/F_{11}$ and $F/F_7$ to the input of $EX_3$, and the output of $F/F_{12}$ and $F/F_8$ to the input of $EX_4$. The outputs from $EX_1$, $EX_2$, $EX_3$ and $EX_4$ are all transmitted to an NOR circuit $NO_4$ as inputs. The output terminal of $NO_4$ is connected to an input terminal of $SR_{13}$, and an output of $SR_{13}$ to an input terminal of $SR_{14}$. The output from $SR_{13}$ is transmitted to the AND circuit $AN_1$ as the input, as described previously, and is also supplied as the reset inputs to $F/F_5$ through $F/F_8$. The output from $SR_{13}$ is also supplied to the input terminal of the inverter circuit $I_{13}$. Then, the NOR circuit $NO_5$ constituting a one-shot circuit receives, as inputs, the output of $I_{13}$ and the output of $SR_{14}$, and the output, i.e., the output h of $NO_5$ is transmitted to the OR circuit $OR_3$ as the input, as previously described.

Figure 3:
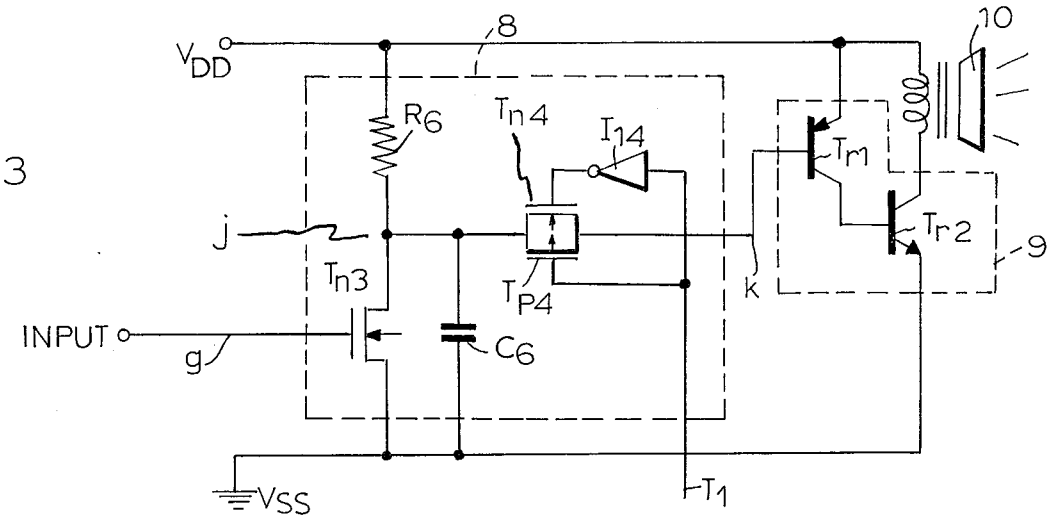
FIGS. 2 and 3 are circuit diagrams of the time signal indication section of a time signal clock, according to the present invention.

The modulation circuit 8 to which the output g from the inverter $I_{12}$ is added, the output circuit 9 and the time announcing device 10, are shown in FIG. 3. The output g from $I_{12}$ is transmitted to the gate of the n-channel FET $Tn_3$. The source of $Tn_3$ is coupled to $V_{SS}$ and the drain thereof is connected to one end of the resistance $R_6$ connected to the $V_{DD}$ supply at the other end and to one end of a capacitor $C_6$ coupled to $V_{SS}$ at the other end, and is also associated with an input terminal of a transfer gate $TG_4$ composed of a pair of transistors $Tp_4$ and $Tn_4$. The output k of $TG_4$ is supplied to the base of a pnp transistor $Tr_1$. The clock signal $T_1$ is supplied to the gate of $Tp_4$, and the inverse phase signal $T_1$ through an inverter $I_{14}$ to the gate of $Tn_4$. The emitter of $Tr_1$ is coupled to the $V_{DD}$ supply, and the collector thereof to the base of the npn transistor $Tr_2$. The emitter of $Tr_2$ is connected to $V_{SS}$, and the speaker is coupled between the collector of $Tr_2$ and the $V_{DD}$ supply. Actual examples of the resistances and capacitors used in FIGS. 2 and 3 are listed in the table below.

| | | |
|---|---|---|
| $R_1$ = 100 KΩ | $C_1$ = 0.05 | μF |
| $R_2$ = 100 KΩ | $C_2$ = 0.05 | μF |
| $R_3$ = 47 KΩ | $C_3$ = 0.022 | μF |
| $R_4$ = 820 KΩ | $C_4$ = 1 | μF |
| $R_5$ = 33 KΩ | $C_5$ = 10 | μF |
| $R_6$ = 1 KΩ | $C_6$ = 4.7 | μF |

Figure 4:
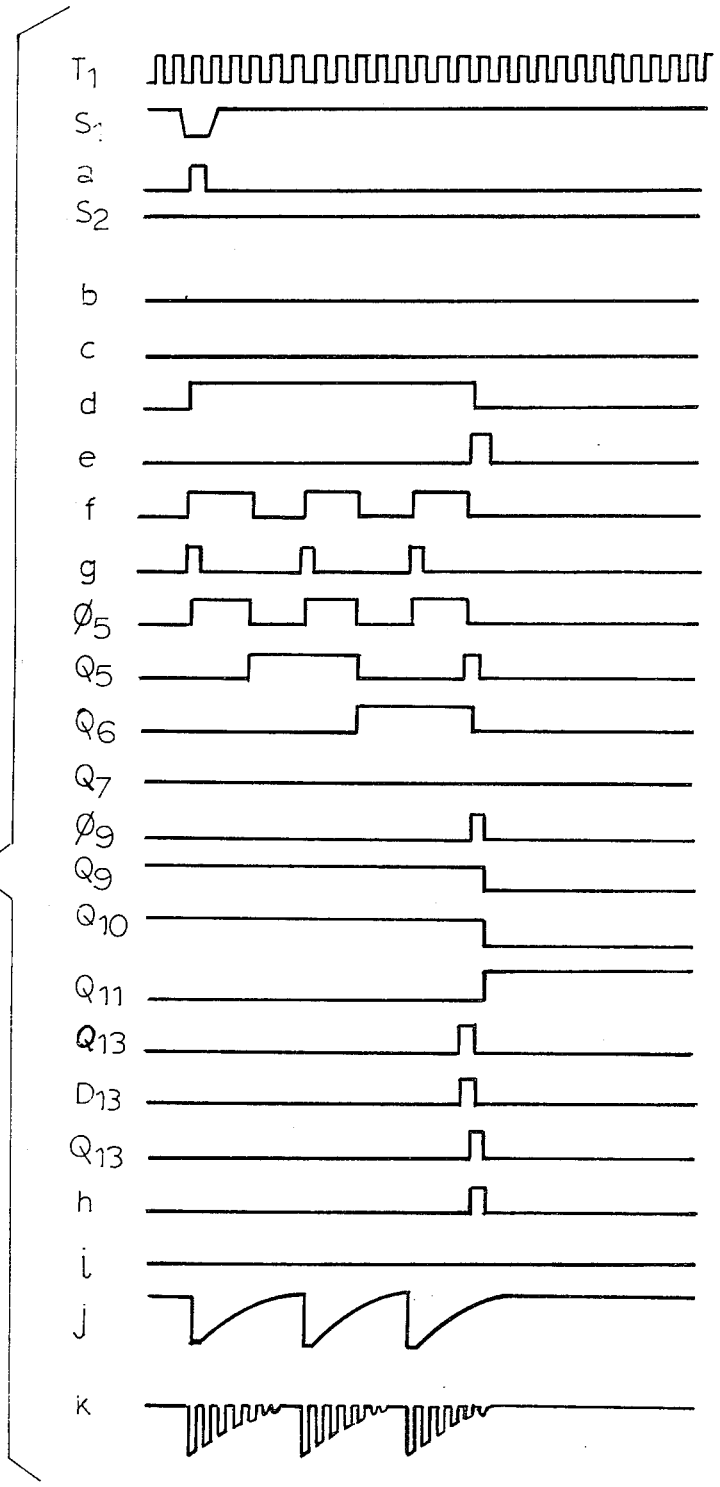
FIG. 4 is a wave form diagram of the signals at various points during the set time in the time signal clock shown in FIGS. 2 and 3.
Figure 5:
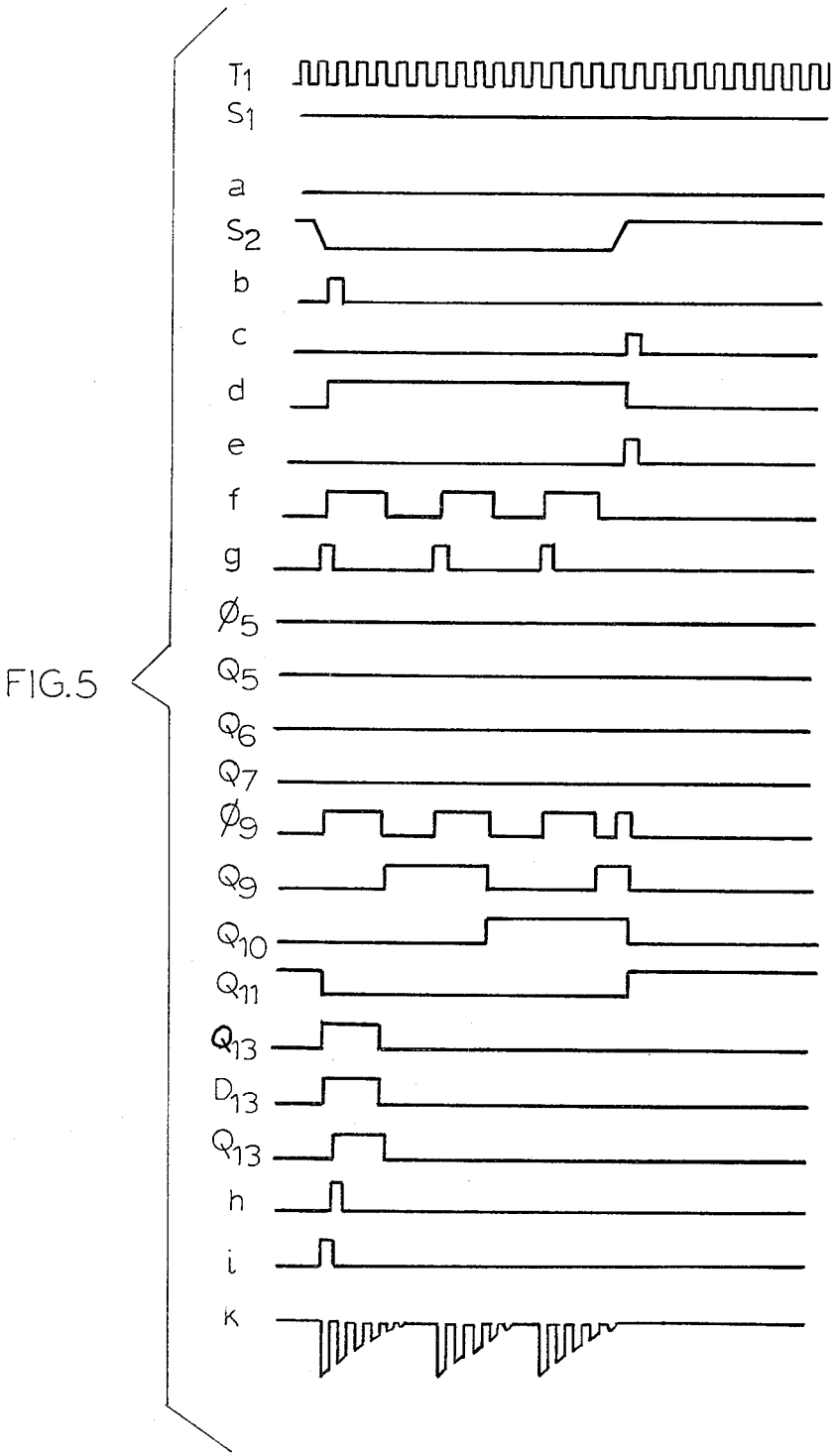
FIG. 5 is a wave form diagram of the signals during the correction time in a time signal clock.
Figure 6:
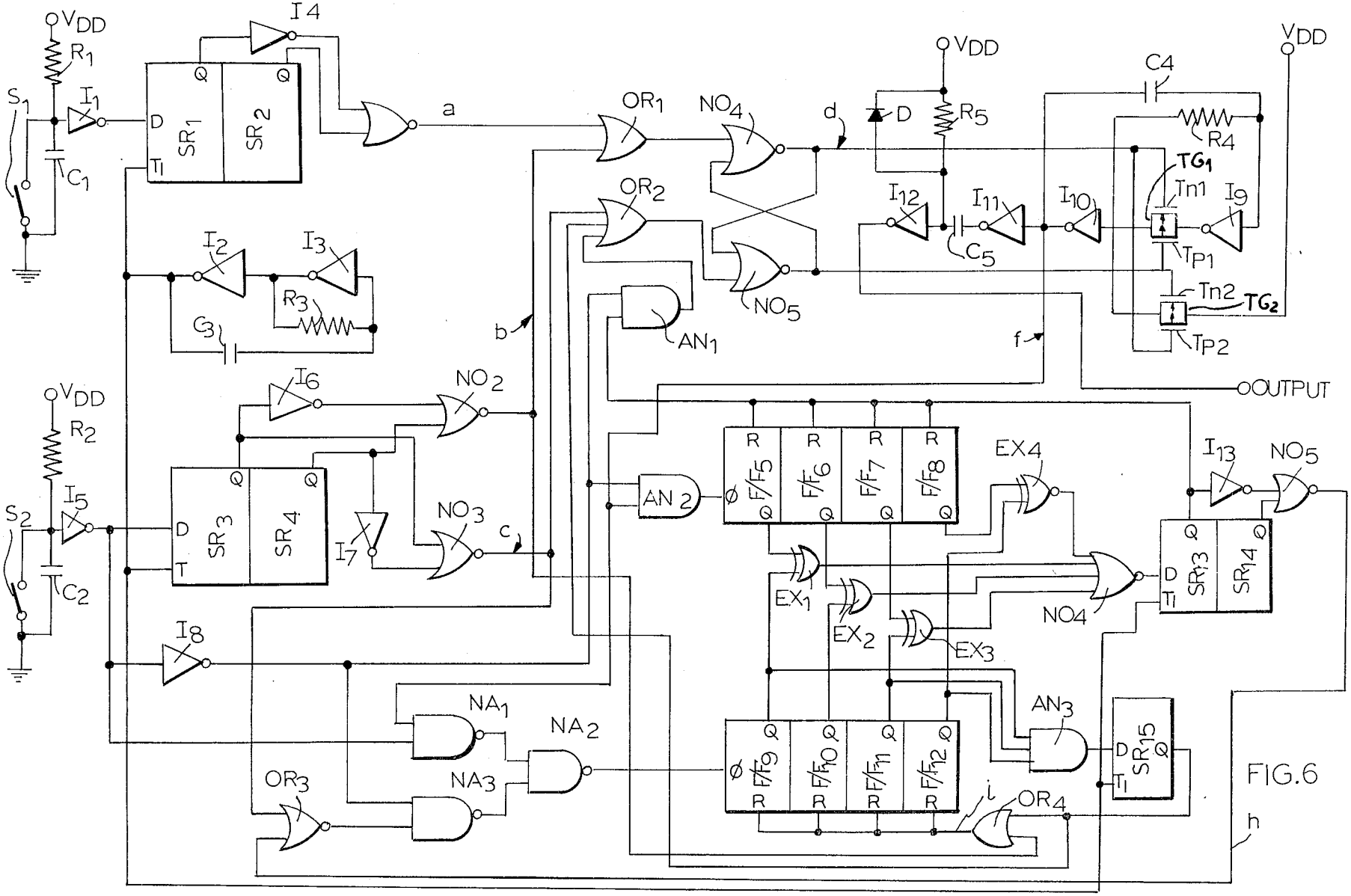
FIGS. 6 and 7 are circuit diagrams of the essential parts of other embodiments of the time signal indication section of a time signal clock of the present invention.

In the following, the time announcing operation according to this invention is described with reference to the time charts of FIGS. 4 and 5. FIG. 4 is a wave form diagram of the signals at various points respectively corresponding to each letter mark in FIGS. 2 and 3 at the time of normal operation, and FIG. 5 those at the time of correction. In FIGS. 4 and 5, $\phi_5$ denotes the wave form at the $\phi$ terminal of $F/F_5$; $\phi_9$ the wave form at the $\phi$ terminal of $F/F_9$ $Q_5 \sim Q_{13}$, the wave forms at the Q terminals of $F/F_5 \sim F/F_{13}$; and $D_{13}$ the wave form at the D terminal of $SR_{13}$.

Now, as the signal level changes from the "1" level to the "0" level at the set time, as shown by $S_1$ in FIG. 4, the output a from the NOR circuit $NO_1$ is at the "1" level for one cycle period of the clock signal $T_1$. Then, the RSF/F composed of $NO_4$ and $NO_5$ is brought to the set state by the signal transmitted through $OR_1$, and the output d changes from the "0" level to the "1" level. Then, $TG_1$ assumes an "ON" state, while $TG_2$ assumes an "OFF" state. As a result, the pulse oscillation is started, and as the output, i.e., the output f of $I_{10}$, a continuous pulse of about 1 Hz is produced. At this time, $AN_2$ is opened, but $NA_1$ is closed; for this reason, the number of pulses is counted only at the counter circuit 3, but not at the memory circuit 4.

If it is assumed that, as shown by $Q_9$, $Q_{10}$, $Q_{11}$ and $Q_{12}$ in FIG. 4, the state "3", that is the state in which $Q_9$ and $Q_{10}$ are at the "1" level, and $Q_{11}$ and $Q_{12}$ at the "0" level, is stored in the memory circuit 4, when the counter circuit 3 is brought to the state "3", that is the state in which $Q_5$ and $Q_6$ are at the "1" level, and $Q_7$ and $Q_8$ at the "0" level, all the Exclusive OR's are in the identical state, thereby giving the output of the "0" level. As a result, the input $D_{13}$ of $SR_{13}$ changes from the "0" level to the "1" level. Then, the output $Q_{13}$ of $SR_{13}$ becomes the "1" level after a delay of one cycle period. As a result, $Q_{13}$ resets the internal state of $F/F_5$ through $F/F_8$, thereby changing $Q_5$ through $Q_8$ to the "0" level, and at the same time, $Q_{13}$ serves as the reset input to the RSF/F, thereby changing the output d again to the "0" level. Then, $TG_1$ is made nonconductive, and $TG_2$ is made conductive, causing the oscillation to stop. As the input $D_{13}$ of $SR_{13}$ changes from the "0" level to the "1" level, the output h of the one-shot circuit which constitutes the comparison circuit is at the "1" level only for one cycle period of the clock signal T. This signal is passed through $OR_3$, $NA_3$ and $NA_2$, to supply the input signal to the memory circuit 4, thereby advancing the internal state thereof by one from "3" to "4". That is to say, the state of $Q_9$ and $Q_{10}$ being at the "1" level and $Q_{11}$ and $Q_{12}$ at the "0" level changes to the state of $Q_{11}$ being at the "1" level, and $Q_9$, $Q_{10}$ and $Q_{12}$ at the "0" level. The oscillation output f is converted through the differential circuit into a pulse with a low duty cycle, as shown by g. Only when g is at the "1" level, $Tn_3$ assumes the "ON" state, and the drain of $Tn_3$ becomes the "0" level. When $Tn_3$ is in the "OFF" state, it changes to the "1" level with the time constant set by the resistance $R_6$ and the capacitor $C_6$. This signal is modulated into an audible frequency, for example, the clock signal frequency $T_1$, and the modulated signal is transmitted to the pnp transistor $Tr_1$ and npn transistor $Tr_2$, to effect the current amplification. Then, the speaker 10 in FIG. 3, produces the electronic sound having a reverberation effect in correspondence with the relaxation signal. In this way, there is produced the time indicating signal sounds a number of times corresponding to the time indicating number of the clock or watch.

In the following, the time correction for the time announcement is described. The correction of the time announcing number is made by closing the switch $S_2$. This operation is described with reference to FIG. 5. As the switch $S_2$ is closed by outside operation, the signal changes from the "1" level to the "0" level. Then, the output b from the NOR circuit $NO_2$ is at the "1" level for one cycle period of the clock signal $T_1$, as shown in FIG. 5. This signal is passed through $OR_1$ to bring RSF/F into the set state, causing the pulse oscillation to start, and continuous pulses of about 1 Hz are produced as the output f of $I_{10}$. Simultaneously therewith, the output b of $NO_2$ is passed through $OR_4$, to reset the $F/F_9 \sim F/F_{12}$ of the memory circuit. At this time, since $AN_2$ has already been closed, but $NA_1$ and $NA_2$ are opened, the number of pulses is counted only at the memory circuit 4, but not at the counter circuit 3. Accordingly, only the number of pulses corresponding to the specified time, for example, "3" o'clock are produced as the output f of $I_{10}$, and this output is passed through the differential circuit, the modulation circuit and the output circuit in the same manner as in the case of normal set time, thereby producing the electronic sound from the speaker. Then, if after producing the electronic sound of the specified number of times, for example, "3", the switch $S_2$ is opened, and as a result, the signal level changes from the "0" level to the "1" level, then the output c from the NOR circuit $NO_3$ is at the "1" level only for one cycle period of the clock signal $T_1$, and this signal is passed through $OR_2$, to bring RSF/F into the reset state, causing the pulse oscillation to stop. Simultaneously therewith, the output c of $NO_3$ is passed through $OR_3$, $NA_3$ and $NA_2$, and counted by the memory circuit as the addition of "1" to the internal state therein. In this instance, the state of "3" o'clock is changed into "4" o'clock. That is, the state of $Q_9$ and $Q_{10}$ being at the "1" level and $Q_{11}$ and $Q_{12}$ at the "0" level changes to the state of $Q_{11}$ being at the "1" level, and $Q_9$, $Q_{10}$ and $Q_{12}$ at the "0" level. Whereupon, the clock resumes the normal operation. Then, as the next set time (for example, 4 o'clock) comes, the detection signal is automatically supplied through $S_1$, to produce the electronic sound four times.

If the output h of $NO_5$ is directly added to $NA_3$ as the input, omitting $OR_3$, as is apparent from the previous description, the function of adding "1" to the memory circuit is eliminated. In that state, as the switch $S_2$ is operated to produce the desired number of times, for example, "4" times, which corresponds to the number of times the electronic sound is to be produced, the electronic sound is produced four times at the next set time.

If the output $Q_{15}$ of the shift resistor $SR_{15}$ is added to $OR_4$ as an input and to $OR_2$ as an input, when the electronic sound is produced through the speaker 10 of FIG. 3 by closing the correction switch $S_2$, the number of pulses corresponding to the electronic sound are counted by the memory circuit; then, as the internal state of the memory circuit becomes 13, that is, as all the outputs $Q_9$, $Q_{11}$ and $Q_{12}$ become the "1" level, the output $Q_{15}$ of $SR_{15}$ changes to the "1" level, and this output is passed through $OR_2$, to reset the RS flip-flop, causing the pulse oscillation to stop. Simultaneously therewith, the internal state of the memory circuit is cleared, with all the outputs of $F/F_9$ through $F/F_{12}$ turned to the "0" level. Then, a pulse having the "1" level for the width of the clock signal $T_1$ is produced as the output h of $NO_5$. However, because the gate of $NA_3$ is not opened, the "1" level is not counted into the memory circuit. If the switch $S_2$ is opened thereafter, a pulse is produced as the output c of $NO_3$, and which is passed through $OR_3$, $NA_3$ and $NA_2$, to have a "1" counted into the memory circuit.

While the correction switch $S_2$ continues to be closed, the pulse is produced, and the electronic sound evolves, for the length of the time proportional to the switch closing time. With the circuit construction of this invention, the number of the electronic sounds does not exceed 13; no greater number of the electronic sounds evolves even if the switch $S_2$ is kept closed. Thereafter, as the normal operation is resumed by releasing the switch $S_2$, the electronic sound is produced only once when the next set time comes, corresponding to 1 o'clock. In that way, the correction can be made with great ease.

Figure 7:
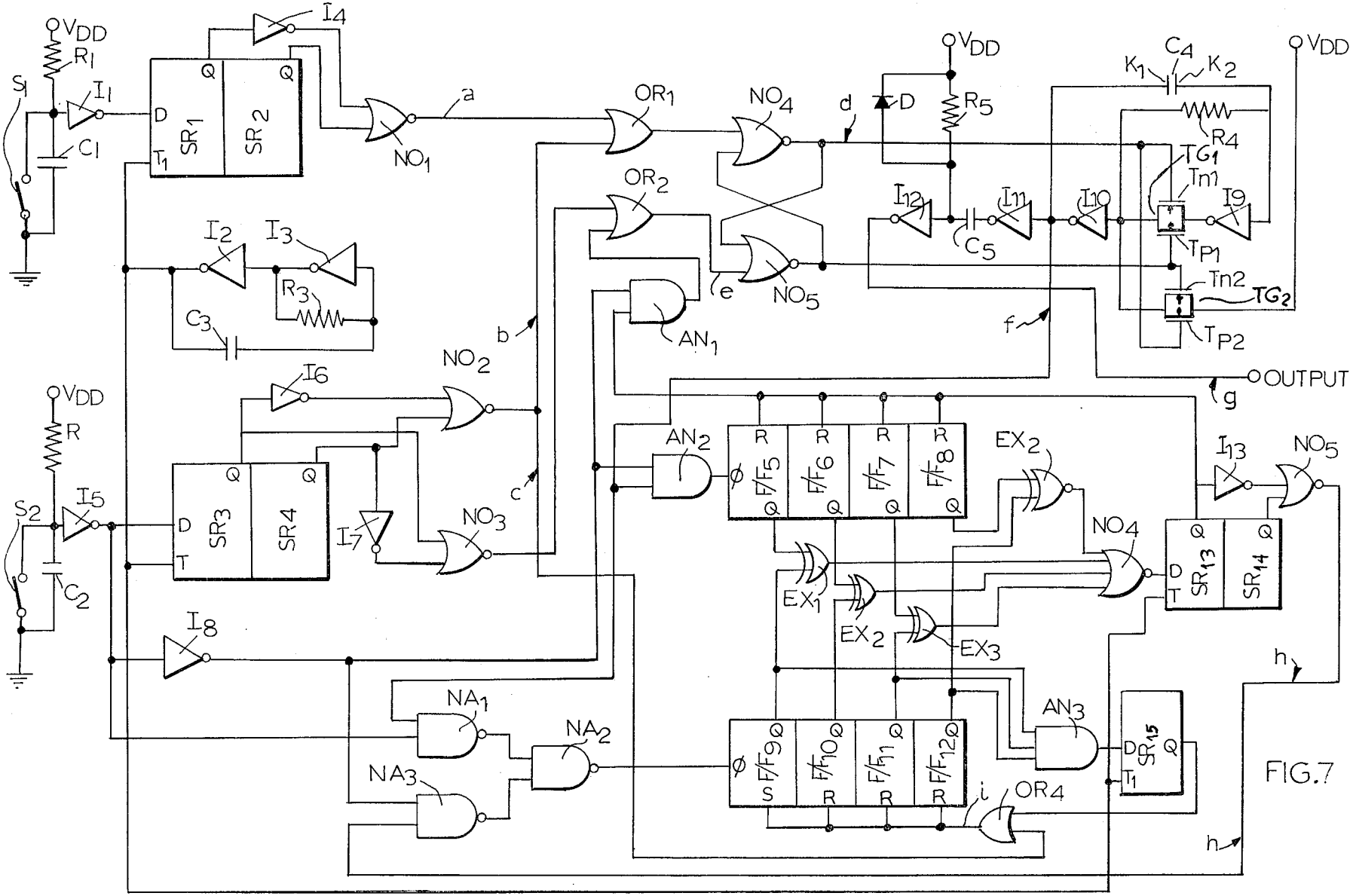

When assembling the circuit of FIG. 2 using integrated circuits, a set type flip-flop $F/F_9$ may be used, as in FIG. 7, in place of a reset type flip-flop $F/F_9$ used in the memory circuit of FIG. 2. In that way, the OR circuit $OR_3$ may be omitted without impairing the function of the circuit of FIG. 2. Furthermore, in making the circuit with integrated circuits, the shift-resistor $SR_{15}$ may be omitted so that the output of $AN_3$ is supplied directly to the input terminal of $OR_4$.

Figure 8:
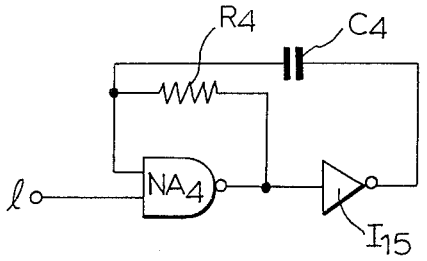
FIGS. 8 and 9 are circuit diagrams of other embodiments of a pulse oscillation circuit according to the present invention.
Figure 9:
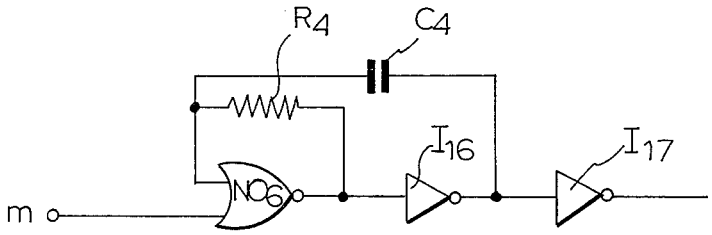

The pulse oscillation circuit 7 composed of the inverters $I_9$ and $I_{10}$, the transfer gates $TG_1$ and $TG_2$, the resistance $R_4$ and the capacitor $C_4$ may be, instead, composed of a NAND circuit $NA_4$, an inverter $I_{15}$, the resistance $R_4$ and the capacitor $C_4$, by transmitting the output of RSF/F, i.e., d being the output of $NO_4$ to the input terminal 1 of $NA_4$ as shown in FIG. 8 and the output of $I_{15}$ to the input terminal of $I_{11}$. Furthermore, as shown in FIG. 9, the pulse oscillation circuit 7 may be composed of an NOR circuit $NO_6$, inverters $I_{16}$ and $I_{17}$, resistance $R_4$ and capacitor $C_4$, by transmitting the signal of the inverse phase to the output of RSF/F, that is the output of $NO_5$, to the input terminal m and the output of $I_{17}$ to the input terminal of $I_{11}$.

In the following, the pulse oscillation control circuit 6 will be described in detail. Since normally, the output of $NO_4$ is at the "0" level, and the output of $NO_5$ is at the "1" level, $TG_1$ is nonconductive, $TG_2$ is conductive and accordingly, the input of $I_{10}$ is at the "1" level. As a result, the output of $I_{10}$ changes to the "0" level, and on the electrode $K_1$, that is, one of electrodes of capacitor $C_4$, a negative charge is stored. The input of $I_9$ from resistance $R_4$ is at the "1" level and the output of $I_9$, at the "0" level. On the other electrode $K_2$ of capacitor $C_4$, a positive charge is stored. If under this condition, the output of $NO_4$ turns to the "1" level, and the output of $NO_5$ to the "0" level, $TG_1$ becomes conductive, and $TG_2$, nonconductive. Thereupon, the input of $I_{10}$ changes from the "1" level to the "0" level, and the charging is made along the path of $V_{DD}$→the positive power supply circuit of $I_{10}$→the output of $I_{10}$→the electrode $K_1$ of the capacitor $C_4$, while discharging is made along the path of the electrode $K_2$ of the capacitor $C_4$→the resistance $R_4$→the input of $I_{10}$→$TG_1$→the output of $I_9$→the negative power supply circuit of $I_9$→$V_{SS}$. As the above-described charging-discharging proceeds, the potential of the input of $I_9$ falls from the $V_{DD}$ level to the $V_{SS}$ level. Then, when the potential becomes less than the threshold voltage, the output changes from the "0" level to the "1" level, while the input of $I_{10}$ changes from the "0" level to the "1" level, and charging is made along the path of $V_{DD}$→the positive power supply circuit of $I_9$→the output of $I_9$→$TG_1$→the resistance $R_4$→the electrode $K_2$ of capacitor $C_4$, while discharging is made along the path of the electrode $K_1$→the output of $I_{10}$→the negative power supply circuit of $I_{10}$→$V_{SS}$, whereby the input potential of $I_9$ again rises from the $V_{SS}$ level to the $V_{DD}$ level. By repeating the above-described charging-discharging, oscillation is effected, with the time constant determined by the product of resistance $R_4$ and capacitor $C_4$. To be noted is the fact that the oscillation is started by the change of the output of $I_{10}$ from the "0" level to the "1" level undergone, simultaneously as the output of RSF/F, that is, the output of $NO_4$, changes from the "0" level to the "1" level; namely, pulse oscillation synchronized with the output of RSF/F (the output of the pulse oscillation control circuit 6) is achieved.

By this construction, the output of the detection circuit and the time indicating pulses are perfectly synchronized with each other, so that any possible gap between the set time and the timing for generating the time indicating signal may be closed.

Figure 10:
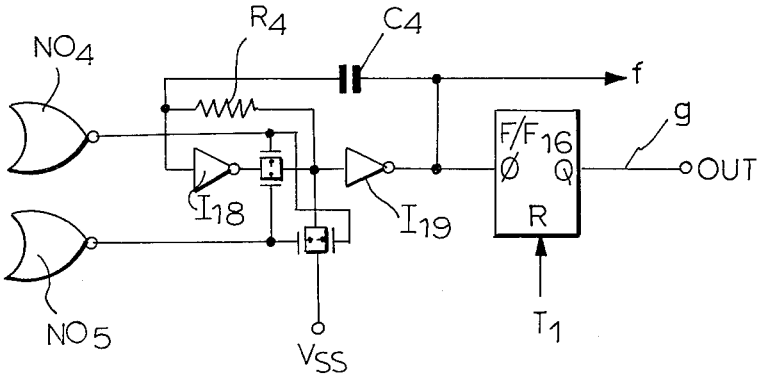
FIG. 10 is a circuit diagram of a circuit of the time signal clock of the present invention in which an integrated circuit is employed.

Note also that in making the differential circuit connected to the output terminal of $I_{10}$, the capacitor $C_5$ may be eliminated by adopting the circuit construction as shown in FIG. 10, i.e., the construction in which the clock signal $T_1$ is transmitted to the reset terminal of $F/F_{16}$.

Since the circuits contained in FIGS. 2 and 3, except for the oscillation circuit, are each composed of the NAND circuits, the AND circuits or the transfer gate circuits, each may be composed of NOR circuits and inverter circuits whereby they may be formed as integrated circuits by use of $I^2L$ in place of C-MOS. This method will permit the output transistors $Tr_1$ and $Tr_2$ to be formed on a common chip.

Figure 11:
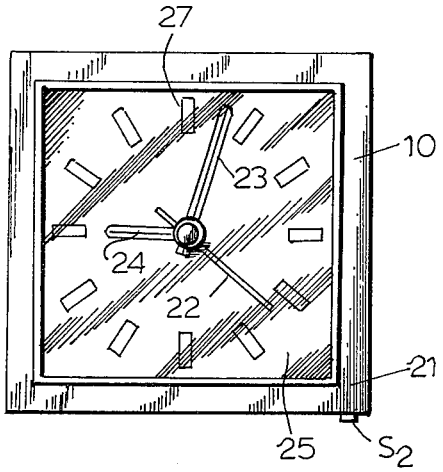
FIG. 11 is a front view of a time signal clock embodying the present invention.

Next, the construction of the time detecting means will be described. FIG. 11 is a front view of a time signal clock embodying the present invention. In FIG. 11, a body 21 is provided with a driving means, not shown in this Figure, under the control of a standard frequency, by which a second hand 22, a minute hand 23 (long hand) and an hour hand 24 (short hand) are driven. Reference numeral 25 designates the graduated plate and 10, an audio speaker. A mark $S_2$ denotes a switch for time indicating signal correction.

Figure 12:
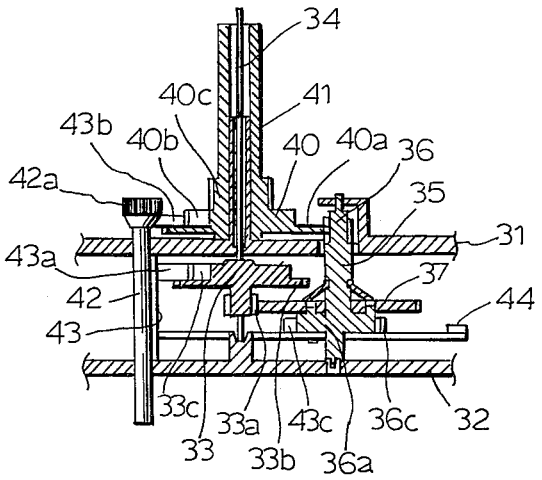
FIG. 12 is a sectional side elevation view of the essential parts illustrating the construction of a set time detecting device of the time signal clock of the present invention.
Figure 13:
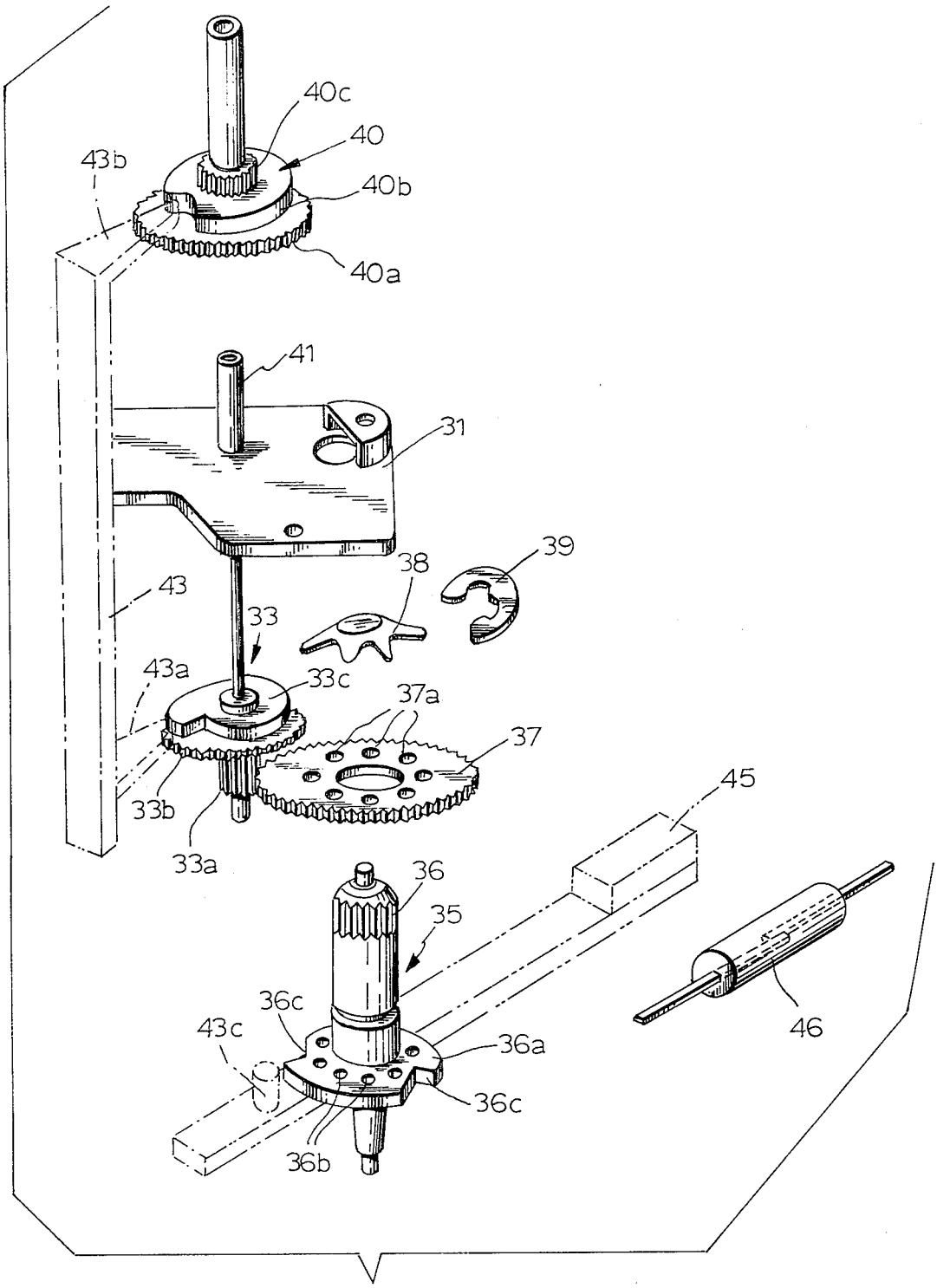
FIG. 13 is an exploded perspective view of the construction of FIG. 12.

Now, the mechanism for actuating the switch $S_1$ when the minute hand and the second hand indicate the set time is described. A sectional view of the essential parts of the time detecting mechanism and the exploded perspective view thereof are respectively shown in FIGS. 12 and 13. In these Figures, a second hand wheel 33 is disposed between base plates 31 and 32; a second hand shaft 34 is attached to the seconds hand wheel 33, and the tip thereof is projected through the base plate 31. The second hand wheel 33 has a pinion part **33*a*, gear part 33*b* and cam part 33*c*. A transmission wheel 35 similarly disposed between the base plates 31 and 32 consists of a pinion 36 and a gear 37 which meshes with the seconds hand wheel 33, the pinion 36 and the gear 37** being stepped-clutch-coupled. The integral number of steps of this stepped-clutch is chosen so as to satisfy the following relationship:

$$n = Z_2/Z_1,$$

where $Z_1$: The number of teeth of the pinion part **33*a*** of the seconds hand wheel.

$Z_2$: The number of teeth of the transmission wheel gear.

Figure 14:
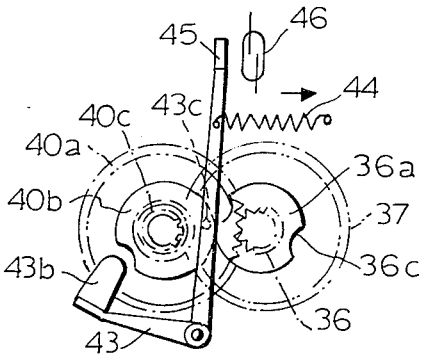
FIG. 14 is a view showing the relations between a lever, the minute hand wheel and the second hand wheel used in a time signal clock of the present invention.

In this embodiment, $Z_1$ and $Z_2$ are chosen to be $Z_1 = 8$, and $Z_2 = 64$, and accordingly, the number of steps n is 8. On the cam part **36*a* formed on the pinion 36, eight bumps 36*b* are formed at equal intervals along the circumference thereof; and the gear 37 provided with eight holes 37*a* which engage with these bumps is mounted on the cam part 36*a*, and is pressed down with a spring 38, thereby composing the stepped clutch. Reference numeral 39 denotes a stop ring for preventing the spring 38 from being drawn out. The cam part 36*a* is formed with two notched parts 36*c*. A minute hand wheel 40 having a gear part 40*a*, a cam part 40*b* and a pinion part 40*c*, are movably engaged with a holding cylinder 41 formed on the base plate 31, the gear part 40*a* meshing with the pinion 36. A hand turning wheel 42 has the shaft passed through the base plates 31 and 32. When it is pressed down from the position shown in FIG. 12, the gear part 42*a* is meshed with the gear part 40*a* of the minute hand wheel 40, so that the timing adjustment may be made by turning the hand turning wheel in that state. An L shape level 43 is rotatably installed on the base plates 31, 32, is provided with a projected part 43*a* which engages with the cam part 33*c* of the seconds hand wheel 33 and a projected part 43*b* which engages with the cam part 40*b* of the minute hand wheel 40, and on the bottom side, with a protruded part 43*c* which engages with the notched part 36*c* of the cam part 36*a*. The lever 43 is, as shown in FIG. 14, normally biased by being pulled in the direction indicated by the arrow. A magnet 45 is securely held on the end part of the bottom side of the lever 43. Facing this magnet 45, a reed switch 46 is disposed, so that it assumes the "ON" state, as it is brought close to the magnet 45**, and assumes the "OFF" state, as it is set apart therefrom.

Figure 15:
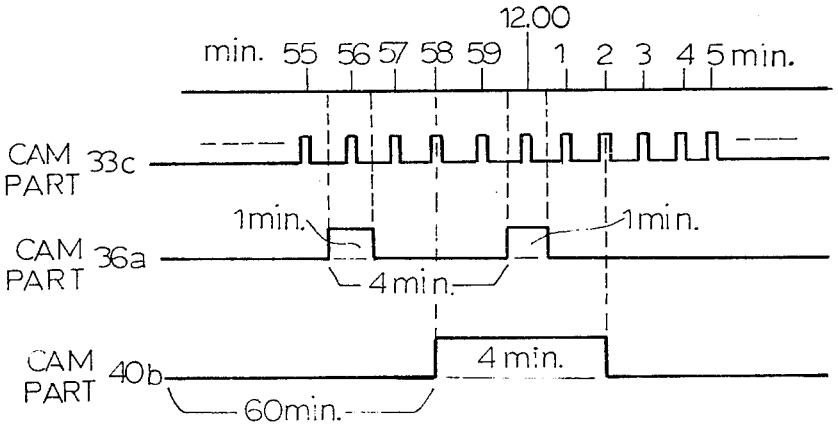
FIG. 15 is a time chart for explaining the manner of driving a time signal reed switch employed in the present invention.

In the following, the way of actuating reed switch 46 is described. Since the cam part **33*c* of the second hand wheel 33 makes one rotation in one minute; the cam part 36*a* provided with two notched parts 36*c* makes one rotation in eight minutes; and the cam part 40*b* of the minute hand wheel 40, makes one rotation in one hour; if the cam part 33*c*, the notched part 36*c* of the cam part 36*a* and the cam part 40*b* are so set as to engage with the projected parts 43*a*, 43*c* and 43*b* of the lever 43, when both the minute hand and the seconds hand indicate the set time, the lever 43 will operate every hour, turning the reed switch to the "ON" state. Thus, the time length of the engagement between the projected parts 43*a*, 43*c* and 43*b* of the lever 43 and the cam part 33*c*, the notched part 36*c* of the cam part 36*a* and the cam part 40*b* are respectively chosen to be several seconds, that is the time required for making the reed switch 46 the "ON" state, about 1 minute and about 4 minutes. The positions of the cam parts 33*c*, 36*a* and 40*b* are set so that the projected part 43*c* comes to engage with the notched part 36*c* about 30 seconds before the projected part 43*a* engages with the cam part 33*c*, and the projected part 43*b* with the cam part 40*b* about 2 minutes before. The minute hand and the second hand are so set as to indicate the set hour, for example, 12 o'clock, when these cam parts are set in the above-described positions; then, the reed switch 46 always becomes "ON" state when the minute hand and the second hand come to the positions for 12 o'clock. These timing relations are displayed in the time chart of FIG. 15. In FIG. 15, the abscissa represents time. The timing adjustments of the hands are made by turning the minute hand wheel 40, pinion 36, the minute wheel (not shown in this Figure) and the hour hand wheel (not shown in this Figure) by way of operating the hand turning wheel 42. Then, the pinion 36 is turned as the minute hand wheel 40 rotates, but because the pinion 36 and the gear 37 are stepped-clutch-coupled at $\frac{1}{8}$ round pitch, a slip occurs between the pinion 36 and the gear 37. As a consequence, while the pinion 36 turns at $\frac{1}{8}$ round pitch, the gear 37 does not turn. The second hand wheel 33, then, continues the turning for the hand movement irrespective of the timing adjusting operation of the hand turning wheel 42. Since the number of teeth of the pinion 36 is chosen to be 8, and the number of teeth of the gear part 40***a* of the minute hand wheel 40 is chosen to be 60, the pinion 36 results in $(\frac{1}{8})\times(8/60)=1/60$ round turning (1 minute) of the minute hand wheel 40. Thus, the pinion 36 is turned $\frac{1}{8}$ round by the operation of the hand turning wheel 42, while the minute hand wheel 40 is turned thereby at 1 minute pitch, and the second hand wheel 33 continues its initial turning. Accordingly no mismatched positional relationship between the second hand and the minute hand will result from the timing adjusting operation for the hands.

If any error is recognized in the operation timing of the reed switch 46, the cam part 33*c* of the seconds hand wheel 33 may be removed. To do so, it is proper to set the minute hand and the second hand in place so as to indicate the set time when the projected part 43*c* and the notched part 36*c* of the cam part 36*a* are in their engaged position. It is also possible to provide projections instead of the notches on the cam.

With this arrangement, in which the second hand wheel, the transmission wheel and the minute hand wheel are respectively provided with cams, and the lever is provided with projections respectively to be engaged with the notches of the cams, the lever is operated when the engagements between each cam and each projection of the lever coincide, whereby the switch $S_1$ is actuated when not only the minute hand but also the second hand come to their respective set time position. In this way, a time indicating signal clock free of error in time indication is obtained.

Whereas in the foregoing embodiment, a system in which principally sound is employed as the time announcing means is described. Use of light as the time announcing means will be made possible by adding an output transistor to the output terminal of the oscillation circuit of FIG. 2, i.e., the output f of $I_{10}$, and connecting the output terminal of the output transistor to a light emitting transistor or a phototransistor.

As described in the foregoing, with the conventional electric or electronic clocks operated from a standard frequency source, only visual means are available for indicating the time, but this invention offers the possibility for indicating the time both visually and acoustically.

With this clock or watch, exact time can be indicated even in dark places or at night, etc. The whole set-up of the circuits, except for several resistances and capacitors, are amenable to integration, permitting low priced and very small time announcing devices to be made available. Since the pulses for the time indicating signals normally are not produced, lowered power consumption is inherently achieved. Because the switching of the switch $S_1$ occurs exactly at the set time, the electronic sound is produced in interlocked timing with the second hand, thus giving a very exact time announcement. Because the preparation for giving the next time announcement is made upon completion of a time announcement, this system involves little possibility of misoperations. At the time of correction, the number of pulses produced is directly counted in the memory circuit, permitting the correction of the time announcement to be made very easily by the mere operation of the correction switch. Moreover, the electronic sound produced from the speaker is a highly audible sound with reverberation effect due to the existance of the sustain circuit incorporated in the system.

What we claim is:

1. An electronic time indicating signal clock comprising:

a time indicating means for indicating the time;

a time measuring means connected to said time indicating means for causing said time indicating means to indicate the time;

a detecting means associated with said time indicating means for detecting when said time indicating means indicates a particular periodic time for which it is desired to generate an audio time indicating signal;

a pulse oscillation means for generating pulses;

a pulse oscillator control means connected to said detecting means and said pulse oscillator means for causing said pulse oscillator means to repetitively generate pulses whenever said detecting means detects one of said particular periodic times until said pulse oscillator control means is reset;

a time indicating signal generating means connected to said pulse oscillator means for generating a time indicating signal whenever said pulse oscillator means generates a pulse;

a counting means connected to said pulse oscillator means for counting the number of pulses generated by said pulse oscillator means;

a memory means for storing the number of time indicating signals desired to be produced;

a comparison means connected to said counting means, said memory means and said pulse oscillator control means, for comparing the count of said counting means with the number stored in said memory means, for resetting said pulse oscillator control means when the count of said counting means equals the number stored in said memory means and for storing in said memory means the number of time indicating signals desired to be produced at the next occurring particular time period; and a correction means connected to said memory means and said pulse oscillator control means, including a correction switch for activating said pulse oscillator control means to cause said pulse oscillator means to generate pulses, for correcting the number stored in said memory means by storing a number in said memory means related to the number of pulses generated by said pulse oscillator circuit during the activation of said correction switch.

2. An electronic time indicating signal clock as claimed in claim 1, wherein:

said comparison means includes means to reset said counting means and means to add one to the number stored in said memory means when said comparison means resets said pulse oscillator control means.

3. An electronic time indicating signal clock as claimed in claim 1, wherein:

said correction means includes means for erasing the number stored in said memory means upon actuation of said correction control switch.

4. An electronic time indicating signal clock as claimed in claim 1, wherein:

said correction means includes means for causing said memory means to count the number of pulses generated by said pulse oscillator means under control of said correction control switch and for adding one to the number stored in said memory means when said correction control switch is deactivated.

5. An electronic time indicating signal clock as claimed in claim 1, wherein:

said time indicating signal generating means comprises an audio speaker and a reverberation effect producing means connected to said audio speaker, for generating a reverberation effect electronic sound.

6. An electronic time indicating signal clock as claimed in claim 1, wherein:

said detecting means comprises a permanent magnet which moves in response to said time measuring means and a stationary magnetically sensitive switch.

7. An electronic time indicating signal clock as claimed in claim 1, wherein:

said detecting means comprises a magnetically sensitive switch which moves in response to said time measuring means and a stationary permanent magnet.

* * * * *